US006370831B1

(12) United States Patent
Marshall et al.

(10) Patent No.: US 6,370,831 B1
(45) Date of Patent: Apr. 16, 2002

(54) RAISED FLOOR SYSTEM AND METHOD OF INSTALLING SAME

(75) Inventors: Dale Marshall; Paul Spavor, both of Calgary (CA)

(73) Assignee: SMED International, Calgary (CA)

( * ) Notice: Subject to any disclaimer, the term of this patent is extended or adjusted under 35 U.S.C. 154(b) by 0 days.

(21) Appl. No.: 09/520,007

(22) Filed: Mar. 6, 2000

(51) Int. Cl.[7] ..... E04B 1/00; E04B 5/00; E04B 7/00

(52) U.S. Cl. ..... 52/263; 52/126.1; 52/126.5; 52/220.3; 52/220.2; 52/220.1

(58) Field of Search ..... 52/220.1, 220.2, 52/220.3, 263, 126.1, 126.5

(56) References Cited

U.S. PATENT DOCUMENTS

| | | | | |
|---|---|---|---|---|
| 2,830,332 A | | 4/1958 | Pawlowski | |
| 3,157,254 A | | 11/1964 | Spiselman et al. | |
| 4,074,488 A | | 2/1978 | Ray, III | |
| 4,250,674 A | | 2/1981 | Feist | |
| 4,438,610 A | | 3/1984 | Fifer | |
| 4,546,580 A | | 10/1985 | Ueno et al. | |
| 4,558,544 A | | 12/1985 | Albrecht et al. | |
| 4,593,499 A | | 6/1986 | Kobayashi et al. | |
| 4,682,453 A | | 7/1987 | Holmgren | |
| 4,736,555 A | | 4/1988 | Negare et al. | |
| 4,905,437 A | * | 3/1990 | Heather | 52/263 |
| 4,996,804 A | | 3/1991 | Naka et al. | |
| 5,052,157 A | | 10/1991 | Ducroux et al. | |
| 5,088,251 A | | 2/1992 | Hazeldine | |
| 5,090,169 A | | 2/1992 | Takeda et al. | |
| 5,184,438 A | | 2/1993 | Takeda et al. | |
| 5,187,907 A | | 2/1993 | Takeda et al. | |
| 5,197,244 A | | 3/1993 | Takeda et al. | |
| 5,245,805 A | | 9/1993 | Takeda et al. | |
| 5,398,466 A | | 3/1995 | Oyama et al. | |
| 5,499,476 A | * | 3/1996 | Adams et al. | 52/220.1 |
| RE35,369 E | | 11/1996 | Ducroux et al. | |
| 5,675,950 A | * | 10/1997 | Schilham | 52/263 |
| 5,713,168 A | * | 2/1998 | Schilham | 52/220.5 |
| 5,749,188 A | | 5/1998 | Belbenoit | |
| 5,791,096 A | * | 8/1998 | Chen | 52/126.6 |
| 5,848,501 A | * | 12/1998 | Taipale | 52/126.4 |

* cited by examiner

*Primary Examiner*—Carl D. Friedman
*Assistant Examiner*—Chi Nguyen
(74) *Attorney, Agent, or Firm*—Flynn, Thiel, Boutell & Tanis, P.C.

(57) ABSTRACT

A raised floor system for installation over a base floor that allows ready access to the space created thereunder. Raised floor panels are supported above the base floor by and secured to base floor web tile assemblies that interconnect one to another. Each base floor web tile assembly includes a plurality of hollow metal cylinders with a lower portion to which a plastic base floor web tile is over-molded. The base floor web tile has adhesion pads with apertures which allow adhesive to be injected below the tile from above. The adhesive is used to affix the interconnected base floor web tile assemblies to the base floor. Further, an upper surface of each metal cylinder has over-molded thereto a plastic floor panel support boss. The floor panel support boss engages with a threaded panel fastener to secure a raised floor panel to a floor panel support of a base floor web tile assembly. Services such as telephone, electricity and computer cables may be installed in the space under the raised floor panels.

24 Claims, 15 Drawing Sheets

RAISED FLOOR SYSTEM AND METHOD OF INSTALLING SAME

BACKGROUND OF THE INVENTION

1. Field of the Invention

This invention pertains to an improved design of a raised floor system that is also known as: an elevated floor, an access floor, a false floor, a pedestal floor, a cellular floor or a computer floor system.

2. Related Art

A raised floor system is used where it is desirable to maintain ready access below the floor surface to cables, wiring, ducting and other building services. Access floor assemblies of the general class of the present invention are well known in the prior art. Such flooring has been manufactured for many years and is used extensively in computer and control rooms, and more recently in general office areas.

A raised floor system generally consists of a plurality of floor panels that are supported a short distance above a base floor by support members. The floor panels form a raised floor enclosing a space between the raised floor surface and the base floor. The space can be used for the distribution of air, ductwork, electrical wiring, communication wiring and computer cables, as well as many other services. Each panel is individually removable for easy access to the services below and to allow quick, low-cost relocation of service outlets.

Some prior raised floor designs include pedestals with stringers therebetween on which floor panels are supported. The stringers serve to make the floor more rigid, but create a problem in laying additional wiring or ductwork since both the floor panels and the stringers need to be removed to allow access to the space.

Floor panels in much of the prior designs are maintained in position by simple gravity placement, or by being bolted to pedestals or to a combination pedestal and stringer network. As such, in many of these prior designs the floor panels settled after time which resulted in an uneven floor surface prone to rocking when loads were applied to the floor surface. By adjusting each pedestal, corrections could be made to account for the settling of the floor panels but this process is often time consuming and disruptive of office routine, as well as expensive.

To address this concern, in U.S. Pat. No. 4,438,610 to Fifer, free-standing pedestals are used to support interlocking floor panels above the base floor. During installation, pedestals are arranged along the base floor in a predetermined array and then floor panels are interlocked and secured to the pedestals. Thus, the precise location of the pedestals is only determined once the floor panels are installed. Adhesive is then used to secure the pedestals to the base floor.

Although the floor surface of the raised floor system described in U.S. Pat. No. 4,438,610 is sturdy and resists settling/deformation, the design and process of installing a raised floor according to this design is tedious and time consuming due to the careful measuring and layout required to assure pedestal placement at each corner of a floor panel plus the subsequent trial and error involved in getting the pedestals correctly positioned during actual installation. In addition, each pedestal must then be individually secured to the base floor and leveled.

To address the problems associated with pedestals and/or stringers, U.S. Pat. No. 4,905,437 to Heather suggests a plastic floor support module of unitary construction. The module comprises a plurality of support props extending upward from an integral frame arrangement with integral connection means for joining the module to a support prop of an adjacent floor support module. Support props are formed to accept a threaded fastener by which the corner of a floor panel may be secured and/or to support the underside of the floor panel. This configuration minimizes the necessity of leveling the floor panels and provides better support for the floor panels since each floor panel rests on support props at its corners and at various points about its interior area.

However, installation and repair of the flooring system disclosed in U.S. Pat. No. 4,905,437 is difficult due to the unitary nature of the floor support module. The floor support modules interconnect one to another forming an array to which the floor panels are secured. There is not a one-to-one relationship between any given floor support module and floor panel. Thus, positioning of floor panels is dependent on the location of the nearest support prop to each of its four corners. Often times, a floor panel will not align with a support prop at each corner. This results from a variety of causes, including dimensional build which can occur as a consequence of incidental stretching of the unitary floor support module during installation, i.e., stretching that occurs when modules are laid and connected on the base floor and then lifted so that adhesive may be applied to the under surface of the module. When floor panels do not readily align with support props, subsequent positioning of the floor panels is often tedious and difficult because it requires reworking areas already installed.

In addition, if a support prop or module of the floor system described in U.S. Pat. No. 4,905,437 is damaged during or subsequent to installation, it requires that the entire module be removed which can and often does entail the removal of numerous panels. This increases installation and repair time, as well as, the costs associated therewith.

Accordingly, what is needed is a raised floor system that incorporates a stable raised floor surface with a supporting structure that allows ready access to the space created therein. In addition, the raised floor system must be designed for ease of installation over a base floor surface, as well as, allow for ease of subsequent repair.

SUMMARY OF THE INVENTION

To achieve the foregoing and other objects, and in accordance with the purposes of the present invention as embodied and broadly described herein, the raised floor system of the present invention provides a uniform floor surface above a base floor with space therebetween. The raised floor system comprises a low-profile base floor web assembly for installing on a base floor and floor panels that are secured thereto.

In the present invention, the base floor web consists of interconnected base floor web tiles. Each tile is comprised of elongate members integrally formed between connection pods and/or docking pods in a square grid-like arrangement. Connection pods are formed between elongate members along two sides of the tile, whereas docking pods are formed between elongate members on the remaining two sides of the tile. The connection pods are circular and the docking pods are semi-circular. However, connection pods and docking pods can be constructed in any complementing shape.

Further, adhesion pads are integrally formed between each elongate member and connection pod, as well as, between each docking pod and elongate member. At approximately the center of each adhesion pad is an aperture for receiving mastic or glue and on the underside of each adhesion pad are slightly raised radial lines. When the base floor web is installed on a base floor, mastic is injected through the apertures of each adhesion pad so that the mastic is applied under the adhesion pad and between the radial lines without lifting the web off the base floor. The slightly raised area created by the radial lines on the underside of the adhesion pad ensures that the mastic is not squeezed out once the weight of the floor panels is applied during installation, which is further described below.

Further, elongate members which form the perimeter of each base floor web tile have means for interconnecting with adjoining base floor web tiles to form the base floor web. The tile interconnection means comprises tabs and/or tab acceptors disposed on the perimeter elongate members of each base floor web tile. Thus, tab acceptors of one base floor web tile are positioned to correspond to and receive respective tabs of adjoining base floor web tiles. Elongate members which form the interior grid of the base floor web tile may be provided with cable tie-downs for securing cables, wires and similar items thereto.

An alternate embodiment of the base floor web tile is comprised of a plurality of perimeter members and interior members arranged in a grid-like manner. In this embodiment, perimeter members form a square perimeter and interior members form an interior grid of the base floor web tile.

Connection pods are integrally formed between perimeter members. Further, a connection pod is integrally formed between the interior members at a midpoint of the tile. Extending from each perimeter connection pod is a tile interconnector, with either a male snap connector or a female snap connector formed at the end thereof that is furthest from the connection pod. The male snap connector may include three connection points. When installed, female snap connectors of one base floor web tile snap onto the mating male snap connector of an adjoining base floor web tile. Thus, the female snap connectors and male snap connectors may be of various complementing shapes.

The base floor web tile provides a matrix into which floor panel supports are secured. A floor panel support is a hollow metal cylinder of uniform height with a raised lip around the circumference of its upper surface. The lipped upper surface has a slot formed through its center which is adapted to receive a corresponding floor panel support boss.

The boss serves as a receptacle for a threaded fastener as well as a cushion to the raised floor panels. Each floor panel support has a base portion that extends outward from and perpendicular to the main body of the floor panel support. The base portion has notches or small holes evenly spaced around its perimeter to resist the torque applied by the panel fastener during installation.

A plastic injection molding process called "over-molding" or "insert-molding" is used to produce a base floor web tile assembly. To begin the over-molding/insert-molding process, floor panel supports are loaded into a mold in an automated injection-molding machine which performs the over-molding/insert-molding process. A plastic base floor web tile is then formed around the base portion of each floor panel support. A connection pod, including over-molded plastic stays, secures each floor panel support to the base floor web tile. The stays secure the base portion of the floor panel support to the web for installation and use but may still allow for the floor panel support to be removed and replaced. In addition, the notches in the bottom portion of the floor panel support are filled with plastic forming small "posts" during the over-mold process which prevent the supports from rotating during installation. Similarly, the floor panel support boss is formed on the upper surface of each floor panel support during the over-mold process. The raised lip around the upper circumference of the floor panel support accommodates receipt of the boss.

During installation, a floor panel is laid horizontally across the flat upper surface of the floor panel supports of a corresponding base floor web tile assembly. Each floor panel has a recess in its upper surface at each corner. The corner recess accommodates the width of the flat upper portion of the panel fastener. When the panel fastener is screwed into the plastic boss of the floor panel support, it secures the recessed corner of the floor panel therebetween. In this way, the panel fastener simultaneously secures the corners of four adjacent floor panels, thereby locating and evenly spacing the floor panels on the surface of the interconnected base floor web tile assemblies. Further, the panel fasteners are also constructed with sufficient tolerance to allow for small inconsistencies in the raised floor level. Thus, upon proper installation, the upper surface of the panel fastener is substantially flush with the upper surface of the floor panel and the lower surface of the floor panel is secured against the upper surface of the floor panel support.

The raised floor system of the present invention is installed on a base floor in what is described as a "top-down" process. Once the base floor web tile assemblies are interconnected, to cover the base floor in its entirety or any portion thereof, the assemblies need not be lifted to apply adhesive, i.e., the "top" (upper surface of the base floor web tile assembly) remains "down" (installed on the base floor) during application of the adhesive. A row of base floor web tile assemblies are laid down on the base floor and interconnected by interconnection means located along the perimeter of each base floor web tile. Mastic is then injected through the apertures of the adhesion pads that extend from each connection pod and docking pod of the base floor web tile. The mastic then fills the area created by the raised radial lines under the adhesion pad. Raised floor panels are then secured by a panel fastener to the upper surface of the base floor web tile assemblies as previously described. The area created by the radial lines under the adhesion pad retains mastic even after the weight of the floor panels is applied thereby assuring adhesion of the base floor web tile assembly to the base floor.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures, where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other applications, including wall and ceiling raised panel arrangements.

Figure 1:
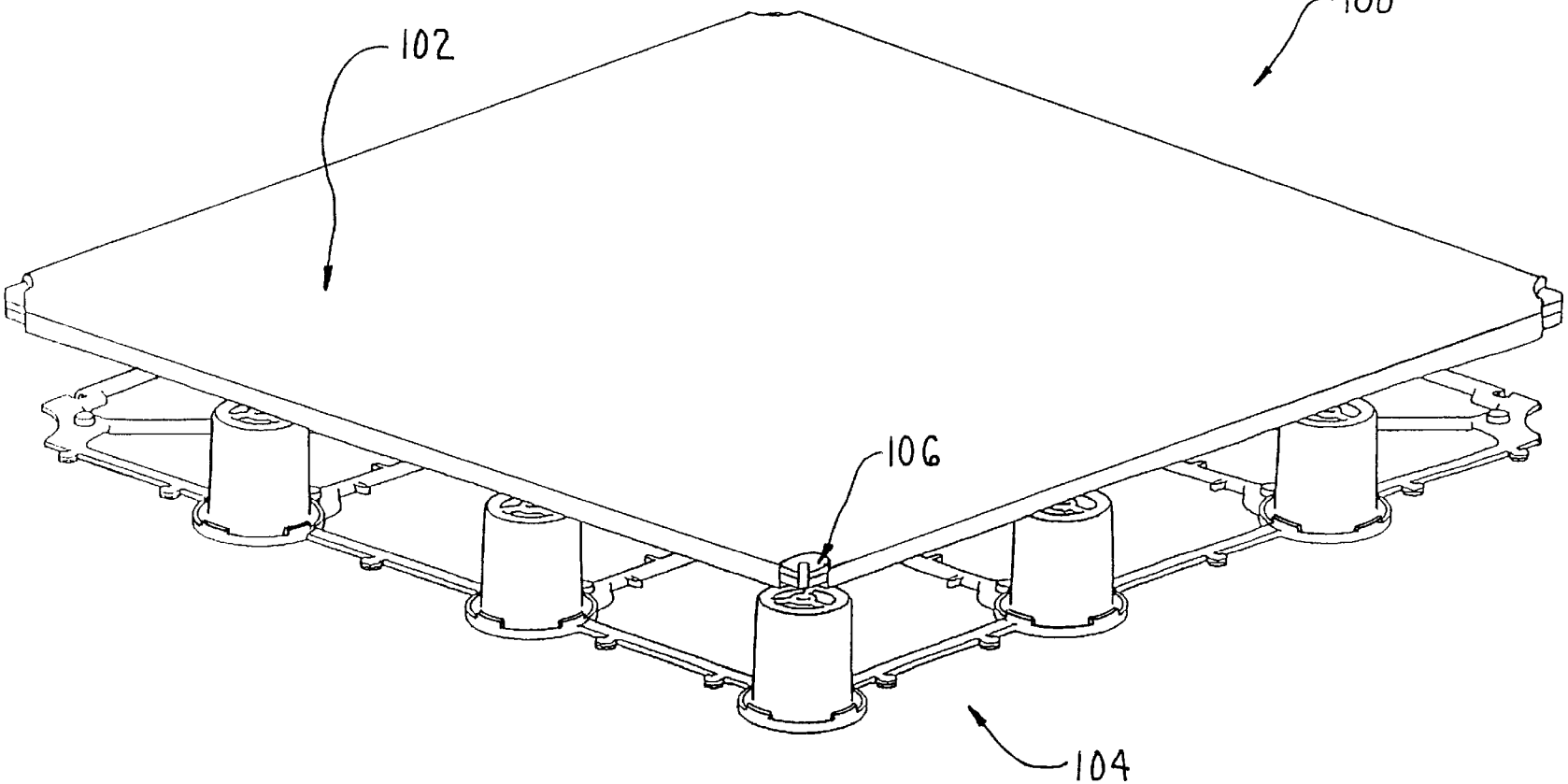
FIG. 1 is a perspective view of a raised floor module.
Figure 2:
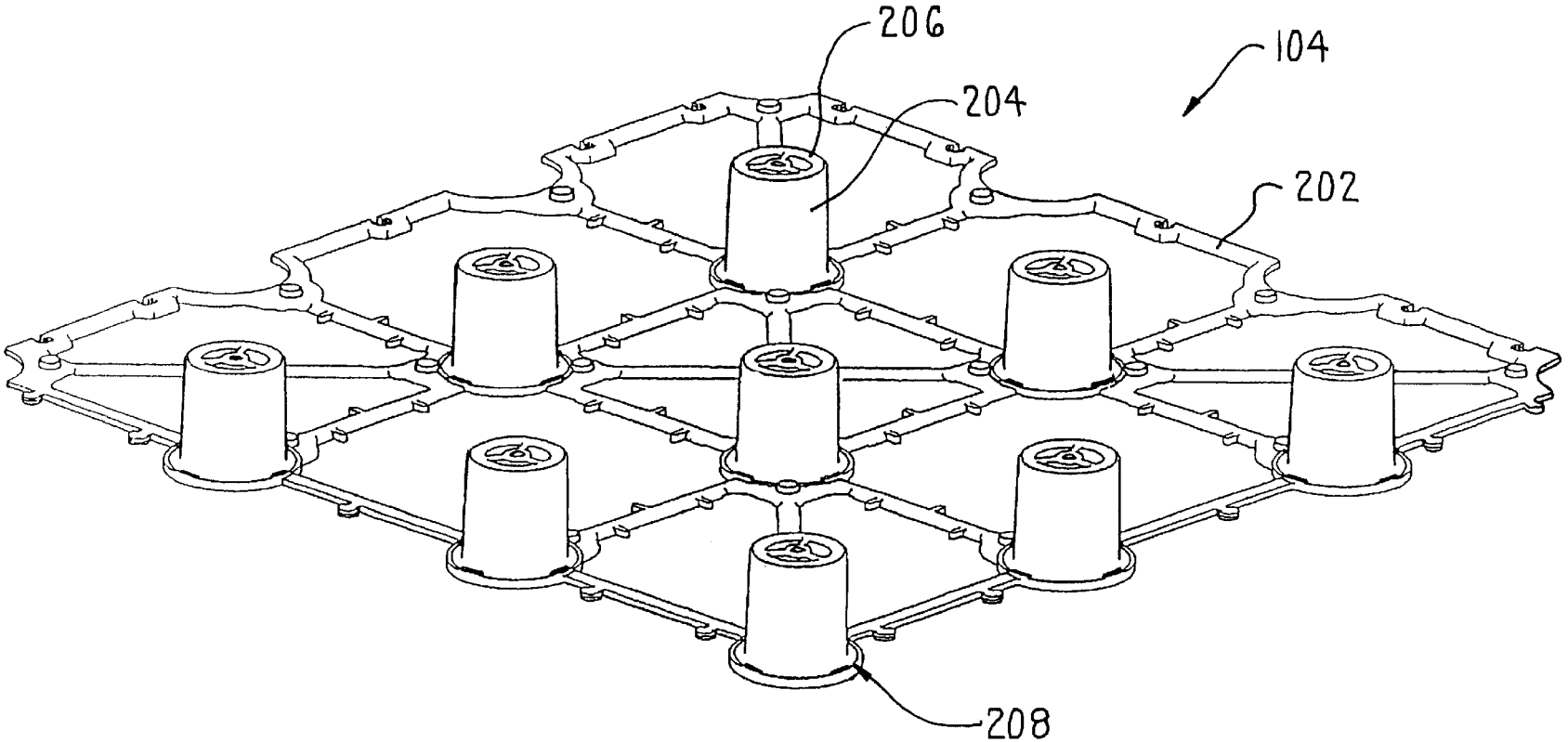
FIG. 2 is a perspective view of a first embodiment of a base floor web tile assembly.

Referring to FIGS. 1 and 2, a raised floor module 100 is shown. The interconnection of raised floor modules 100 across the entirety of a base floor results in a stable, raised floor surface that allows ready access to the space below. FIG. 1 is a perspective view of a raised floor module 100 in accordance with the present invention. FIG. 2 is a perspective view of a base floor web tile assembly 104.

Raised floor module 100 includes a floor panel 102 and a corresponding base floor web tile assembly 104. Floor panel 102 may be made from a variety of materials, such as wood, particle board, concrete, metal or various combinations of these materials. Floor panel 102 is constructed so that each corner has a recess 106. In one embodiment, recess 106 is formed in a sector sized to receive a corresponding sector of an upper portion of a threaded panel fastener (not shown) used to secure floor panel 102 to base floor web tile assembly 104.

As shown in FIG. 2, base floor web tile assembly 104 includes a base floor web tile 202 fitted with a plurality of floor panel supports 204, wherein each floor panel support 204 has a floor panel support boss 206 affixed to an upper surface thereof. Base floor web tile 202 and floor panel support boss 206 are preferably made of plastic but other resilient and flexible materials may be used. Floor panel support 204 is preferably made of metal. In another embodiment, the floor panel support can be made of wood, ceramic, plastic or any other material of suitable strength. The base floor web tile assembly 104 is preferably constructed using an over-molding/insert-molding process which is discussed in greater detail below.

Figure 9:
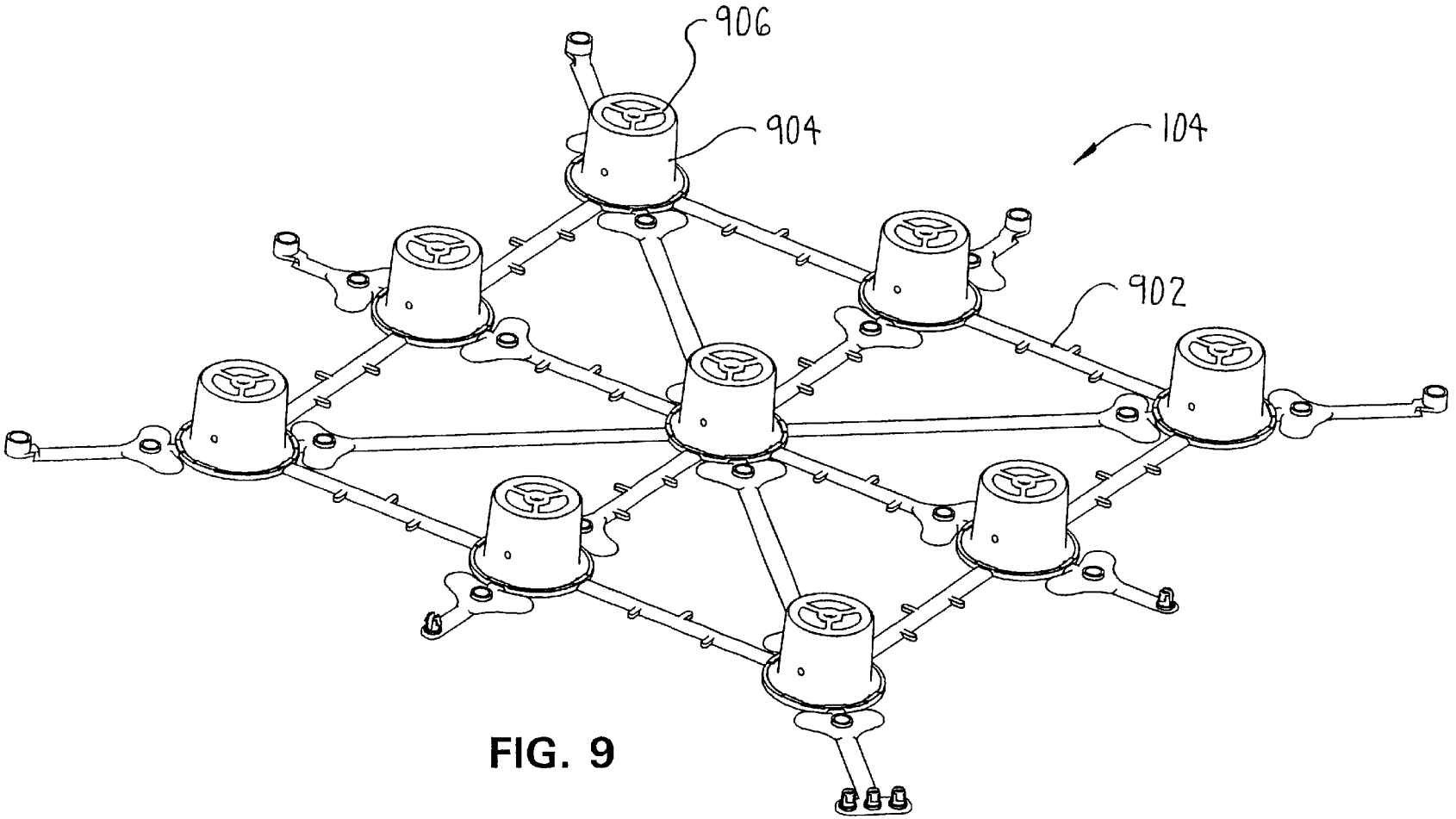
FIG. 9 is a perspective view of a second embodiment of a base floor web tile assembly.

An alternate embodiment of base floor web tile assembly 104, as shown in FIG. 9, includes a base floor web tile 902 fitted with a plurality of floor panel supports 904, wherein each floor panel support 904 has a floor panel support boss 906 affixed to an upper surface thereof.

Figure 3:
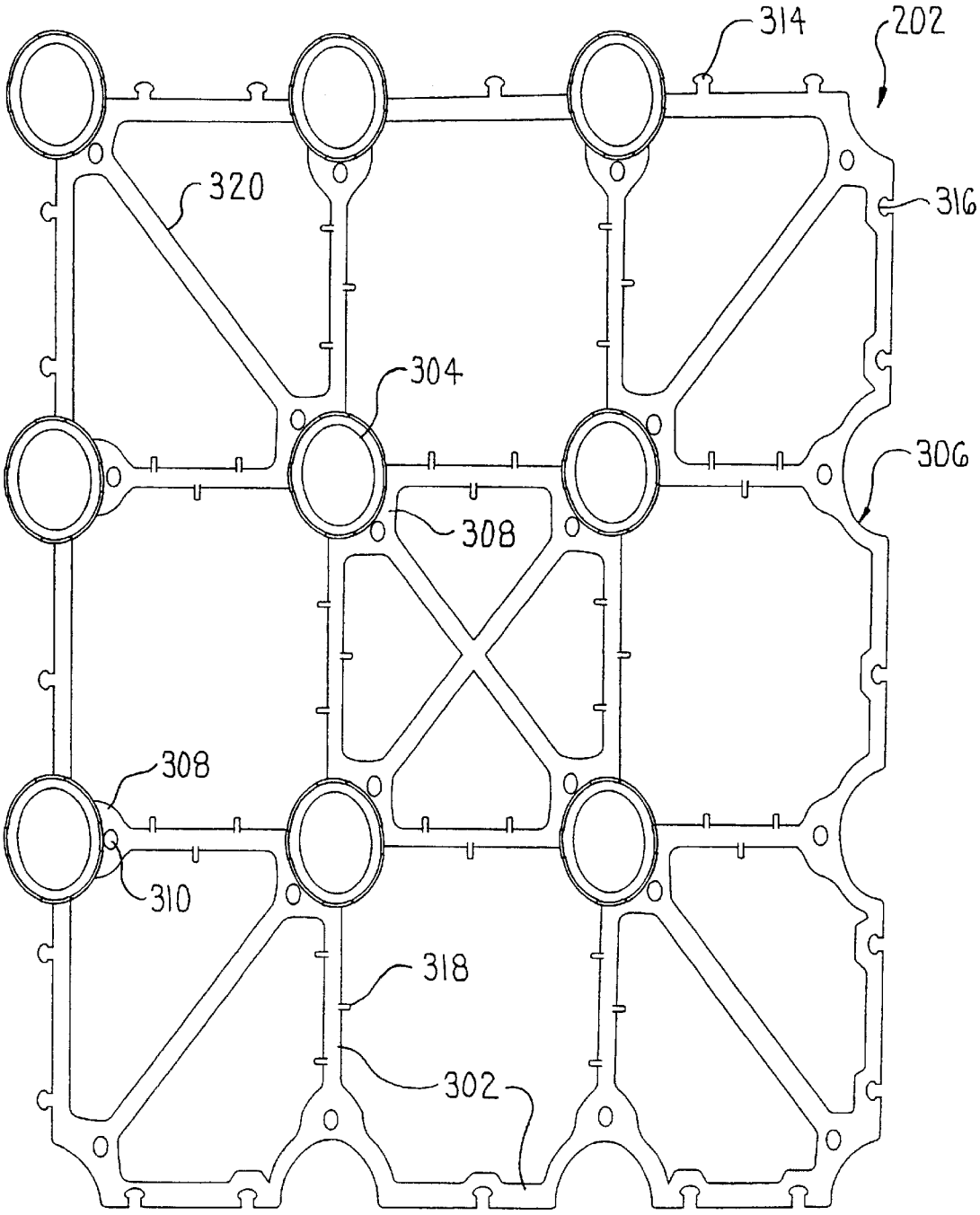
FIG. 3 is a top plan view of a first embodiment of a base floor web tile.

FIG. 3 is a top plan view of a base floor web tile 202. As shown in FIG. 3, base floor web tile 202 is comprised of a plurality of elongate members 302 and diagonal members 320 arranged in a grid-like manner. In the embodiment shown in FIG. 3, elongate members 302 form a square perimeter and an interior grid of base floor web tile 202. Diagonal members 320 provide reinforcement to the base floor web tile thereby preventing the base floor web tile from stretching during installation. In another embodiment, the elongate members may form a rectangular, an octagonal or other polygonal perimeter.

Along two sides of the perimeter of base floor web tile 202, connection pods 304 are integrally formed between elongate members 302. Further, the interior grid of base floor web tile 202 includes connection pods 304 integrally formed between elongate members 302. Along the remaining two sides of the perimeter of base floor web tile 202, docking pods 306 are integrally formed between elongate members 302. However, in another embodiment, connection pods and docking pods may be interchanged between elongate members on all four sides of the tile.

When installed, docking pods 306 of one base floor web tile 202 abut with connection pods 304 of an adjoining base floor web tile 202. Thus, connection pods 304 and docking pods 306 are necessarily of complementing shapes. In the embodiment of the present invention shown in FIG. 3, connection pods 304 are circular, whereas docking pods 306 are semi-circular. In a further embodiment, connection pods may be rectangular, octagonal or any other polygonal with correspondingly shaped docking pods.

Figure 3A:
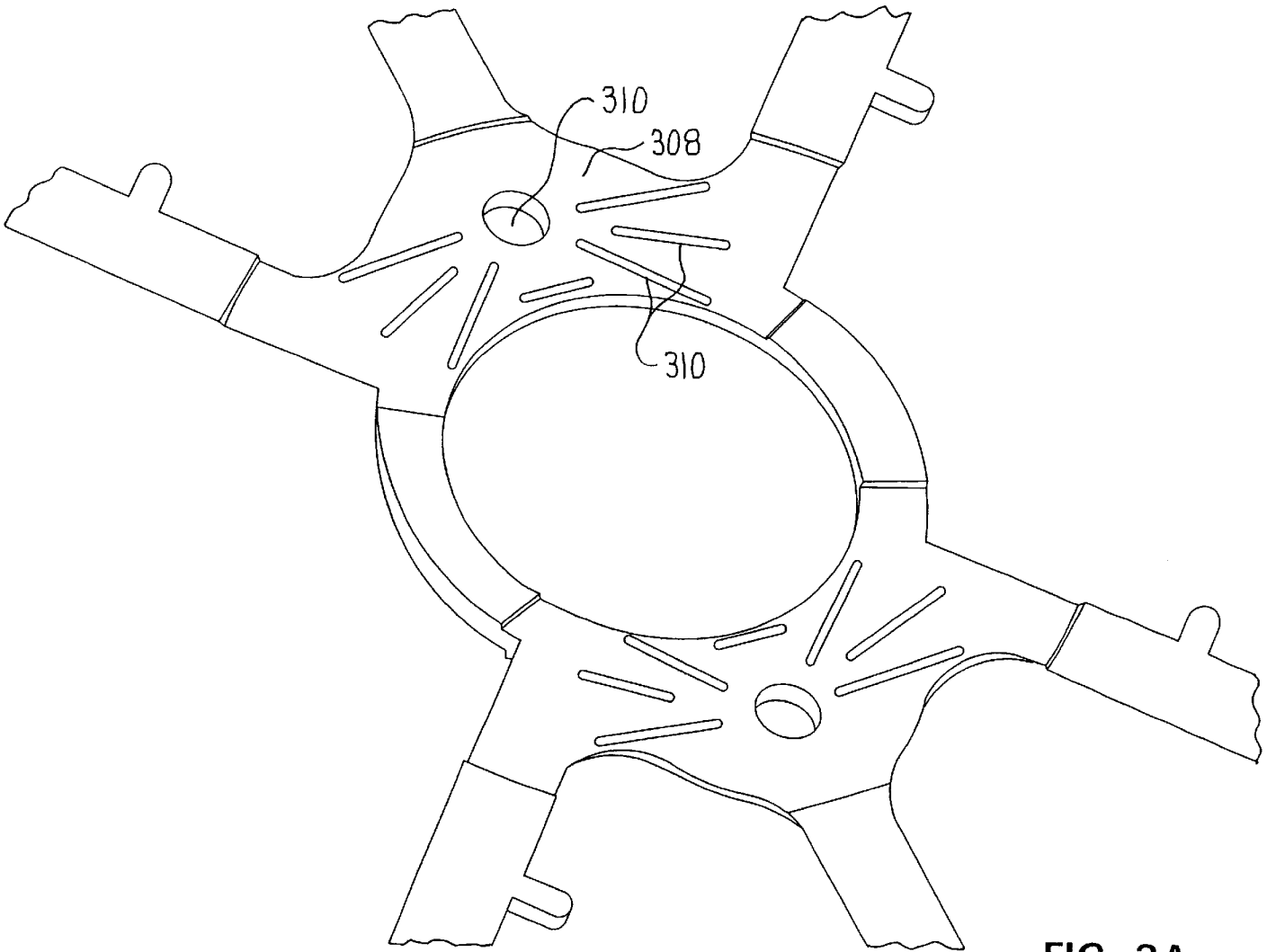
FIG. 3A is a bottom plan view of a connection pod of FIG. 3.

Adhesion pads 308 are integrally formed between connection pods 304 and elongate members 302 as well as between docking pods 306 and elongate members 302. At approximately the center of each adhesion pad 308 is an aperture 310 for receiving mastic or glue and on the underside of each adhesion pad 308 are slightly raised radial lines 312, as shown in the embodiment of FIGS. 3 and 3A. In another embodiment, the adhesion pad may contain several apertures.

Figure 10:
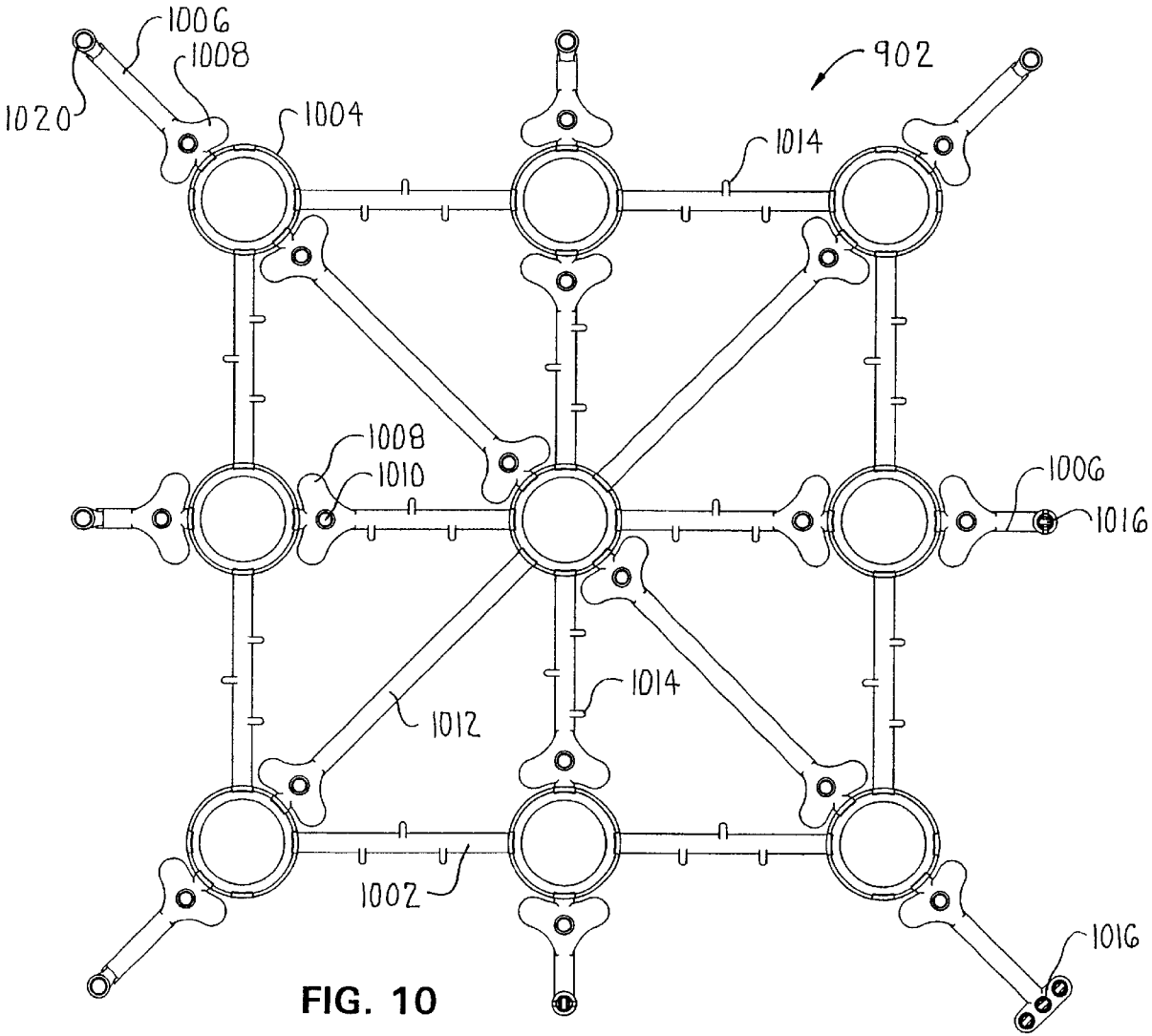
FIG. 10 is a top plan view of a second embodiment of a base floor web tile.

FIG. 10 is a top plan view of an alternate embodiment of base floor web tile 202 of FIG. 3. As shown in FIG. 10, base floor web tile 902 is comprised of a plurality of perimeter members 1002 and interior members 1012 arranged in a grid-like manner. In the embodiment shown in FIG. 10, perimeter members 1002 form a square perimeter and interior members 1012 form an interior grid of base floor web tile 902. A plurality of interior members 1012 are further arranged diagonally to provide reenforcement to base floor web tile 902 to prevent base floor web tile 901 from stretching during installation.

Figure 11:
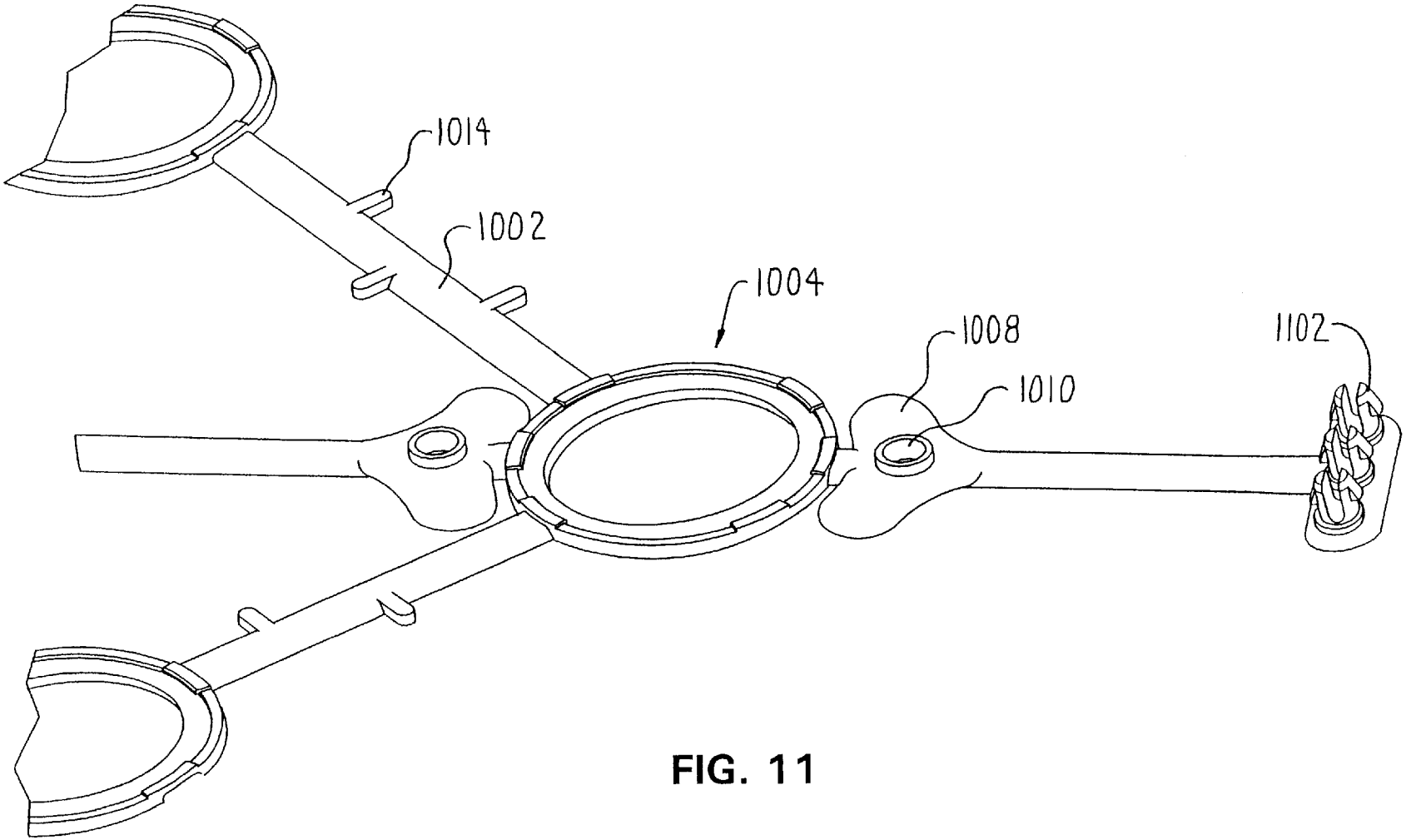
FIG. 11 is a perspective view of a connection pod and a tile interconnector of a base floor web tile of FIG. 10.

About the perimeter of base floor web tile 902, connection pods 1004 are integrally formed between perimeter members 1002, as shown in FIG. 10. Further, base floor web tile 902 includes connection pod 1004 integrally formed between interior members 1012 at a midpoint of the tile. Extending from each perimeter connection pod 1004 is tile interconnector 1006, with either a male snap connector 1016 or a female snap connector 1020 formed at the end thereof that is furthest from the connection pod. Male snap connector 1016 includes a plurality of connection points 1102, as shown in FIG. 11.

Figure 13:
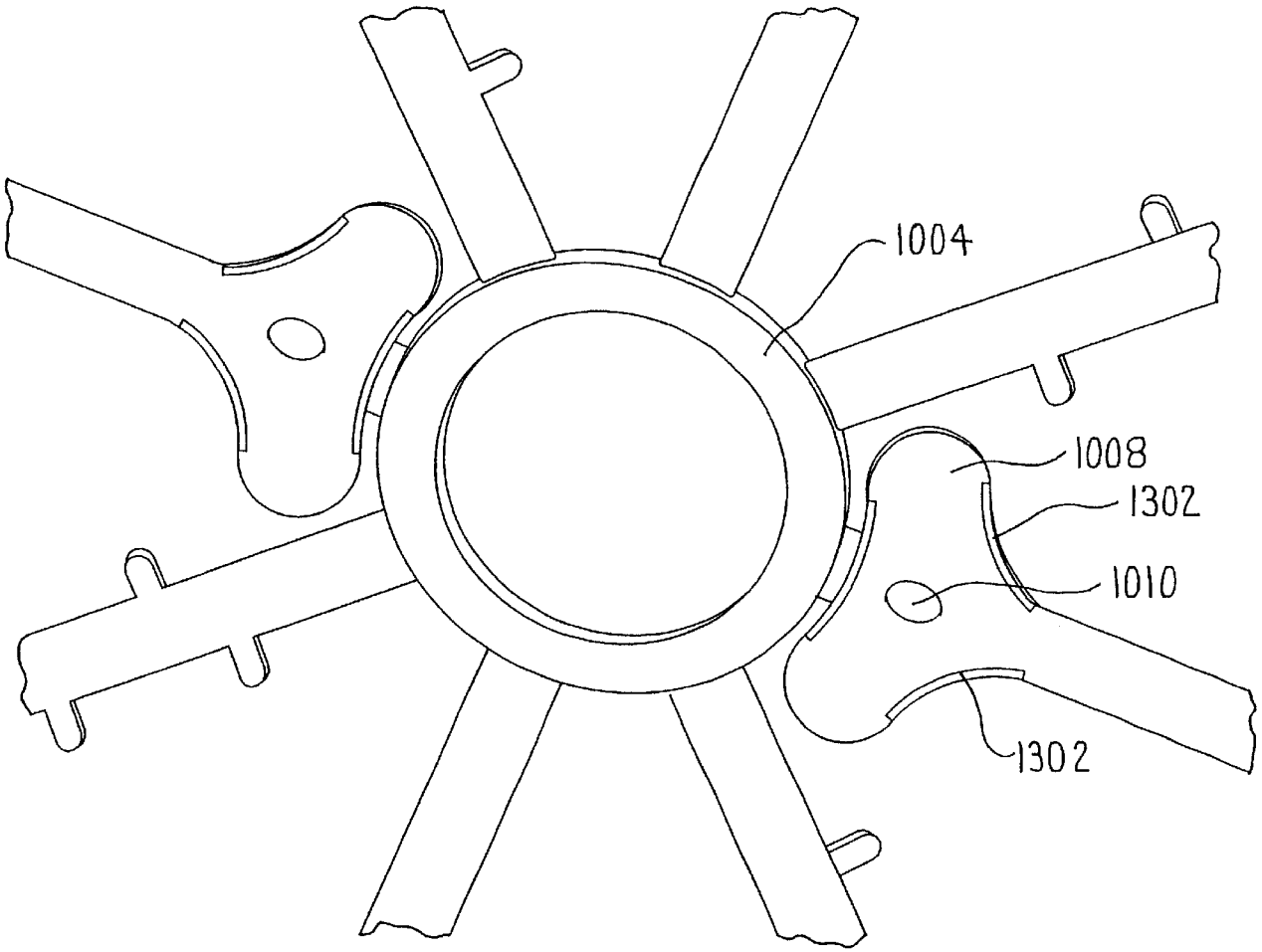
FIG. 13 is a bottom plan view of a connection pod of a base floor web tile of FIG. 10.

Adhesion pads 1008 are integrally formed between connection pods 1004 and interior members 1012. Adhesion pads 1008 are also integrally formed between connection pods 1004 and tile interconnectors 1006. At approximately the center of each adhesion pad 1008 is an aperture 1010 for receiving mastic or glue and on the underside of each adhesion pad 906 are slightly raised portions 1302, as shown in the embodiment of FIGS. 11 and 13.

With reference to the embodiment of FIGS. 2, 3 and 3A, when the base floor web tile assemblies 104 are installed on a base floor, mastic is injected through apertures 310 so that it is applied under adhesion pads 306 and between radial lines 312 without lifting base floor web tile assembly 104 off the base floor. The slightly raised area created by radial lines 312 on the underside of adhesion pads 308 ensures that the mastic is not squeezed out once the weight of floor panels 102 is applied during installation, which is further described below. In another embodiment, the raised area under the adhesion pad is created by raised portions 1302, as shown in FIG. 13. In a further embodiment, the underside of the adhesion pad is notched or scored from the lowest point of the aperture to accept mastic or glue therein.

The base floor web tiles have means to interconnect one to another to ultimately form the base floor web. In the embodiment of FIG. 3, elongate members 302 located on the perimeter of base floor web tile 202 have tabs 314 and tab acceptors 316 disposed thereon which function to interconnect one base floor web tile to an adjoining base floor web tile. The tab acceptors 316 of one base floor web tile are positioned to correspond to and receive respective tabs 314 of an adjoining base floor web tile 202. Further, interior elongate members 302 may be provided with cable tie-down locators 318, as shown in FIGS. 3 and 3A. In another embodiment, elongate members along the perimeter have complementing interlocking patterns by which the base floor web tiles are secured one to another.

Figure 12:
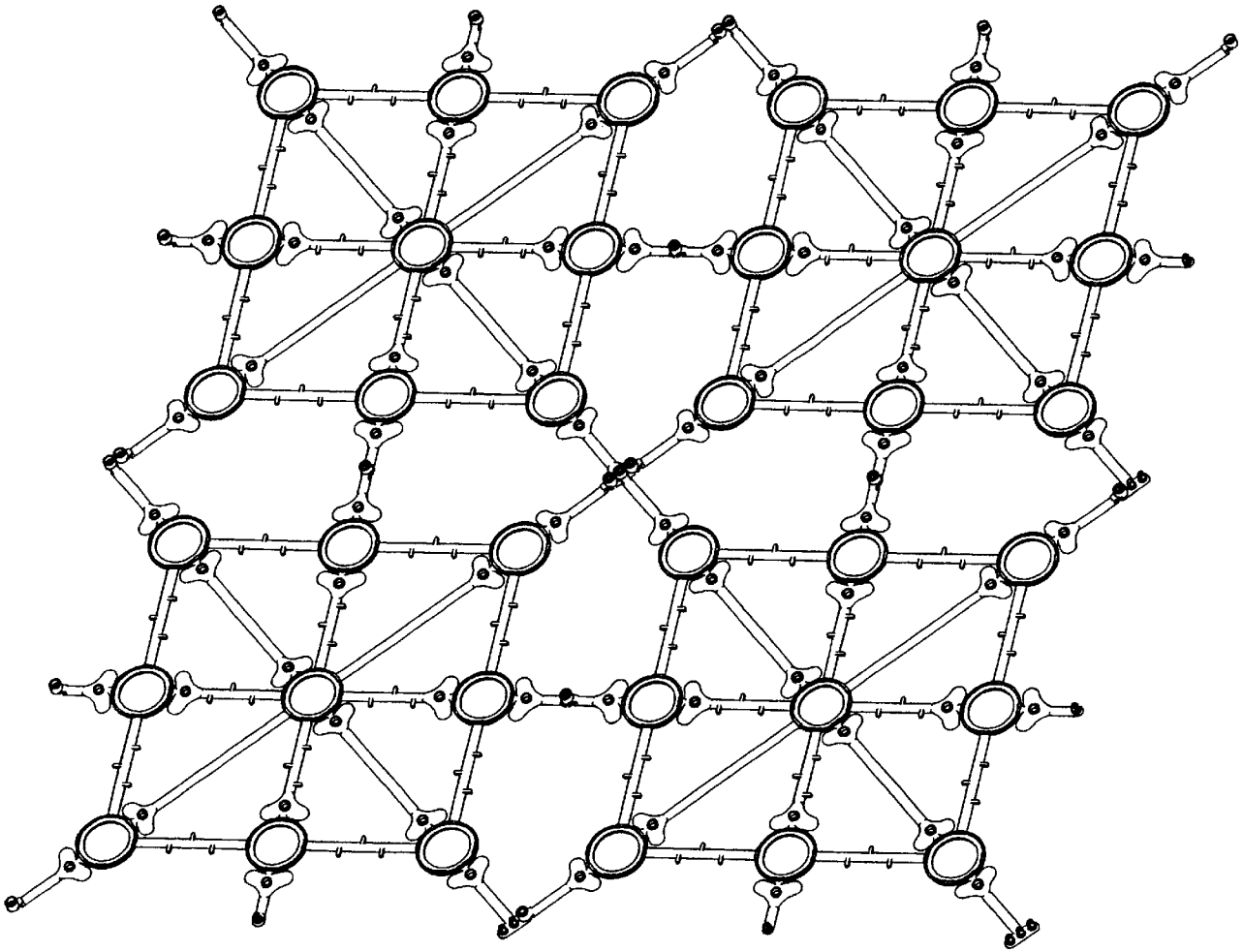
FIG. 12 is a perspective view of interconnected base floor web tiles of FIG. 10.

In the alternate embodiment of the base floor web tile shown in FIG. 10, the base floor web is created by positioning female snap connector 1020 of one base floor web tile over a corresponding male snap connector 1016 of an adjoining base floor web tile and snapping them together, as shown in FIG. 12. Thus, female snap connectors 1020 and male snap connectors 1016 can be of various complementing shapes. Further, perimeter members 1002 and/or interior members 1012 may be provided with cable tie-downs 1014, as shown in FIGS. 10 and 11.

Figure 4:
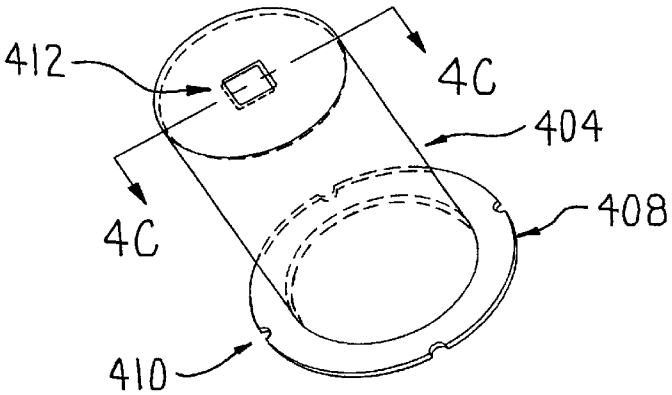
FIG. 4 is a perspective view of a first embodiment of a floor panel support.

Base floor web tiles 202 provide a matrix into which floor panel supports 204 are secured. FIG. 4 is a perspective view of a one embodiment of floor panel support 204. In this embodiment, floor panel support 204 is a hollow metal cylinder 404 of uniform height that has a raised lip 402 around the circumference of its upper surface 412. Further, floor panel supports can be of any suitable shape, cross-section and/or size.

Figure 4C:
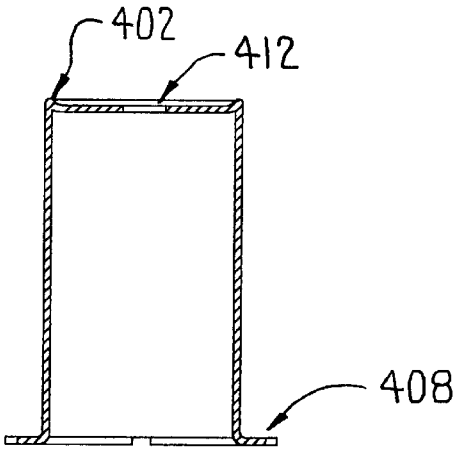
FIG. 4C is a cross-sectional view of the floor panel support of FIG. 4 taken along line 4C—4C.
Figure 4A:
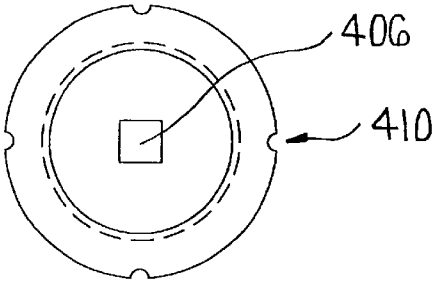
FIG. 4A is a top plan view of the floor panel support of FIG. 4.
Figure 4B:
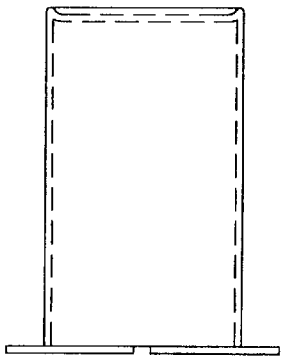
FIG. 4B is a side plan view of the floor panel support of FIG. 4.

The lower edge of metal cylinder 404 forms a floor panel support base 408. Floor panel support base 408 is a circumferential band of material that extends outward from and is perpendicular to the main body of metal cylinder 404, as shown in FIG. 4C. Notches 410 are evenly spaced around the perimeter of cylinder base 408, as shown in FIG. 4 and 4A. In one embodiment, the notches are semi-circular. In further embodiments, the notches may be v-shaped or u-shaped.

Figure 14:
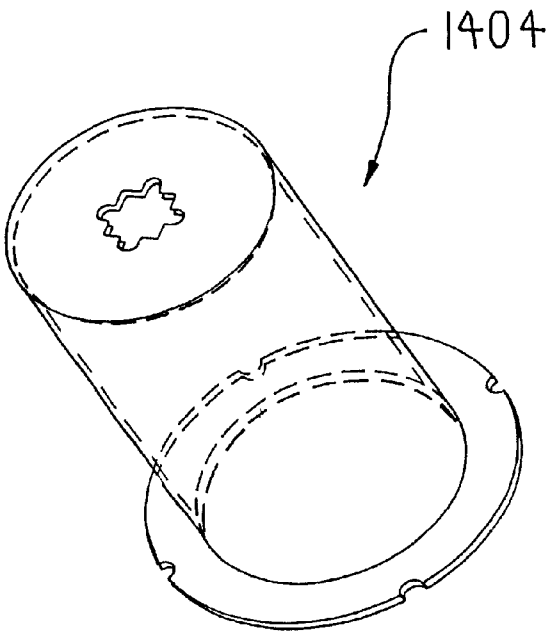
FIG. 14 is a perspective view of a second embodiment of a floor panel support.
Figure 14A:
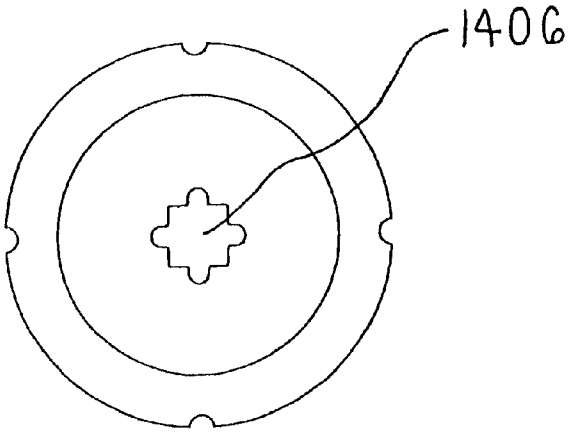
FIG. 14A is a top plan view of the floor panel support of FIG. 14.

As also shown in FIG. 4A, the lipped upper surface 412 of metal cylinder 404 has a slot 406 formed therethrough which is adapted to receive a corresponding floor panel support boss 206. In one embodiment, a square slot is used to prevent the boss from rotating during installation and use. In an alternate embodiment shown in FIGS. 14 and 14A, metal cylinder 1404 has a puzzle-piece-shaped slot 1406 on an upper surface thereof It would be apparent to one skilled in the relevant art that a variety of different shaped slots could be used to prevent rotation of the boss.

Figure 5:
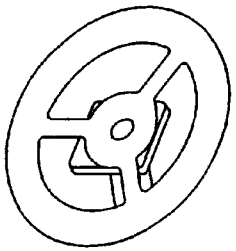
FIG. 5 is a perspective view of a first embodiment of a floor panel support boss.
Figure 5A:
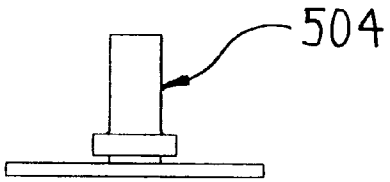
FIG. 5A is a side plan view of the floor panel support boss of FIG. 5.
Figure 5B:
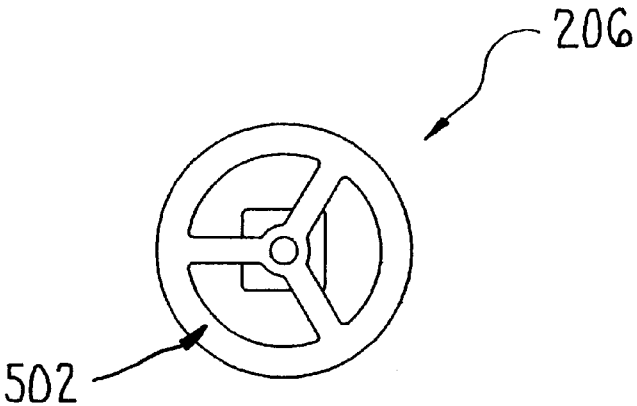
FIG. 5B is a top plan view of the floor panel support boss of FIG. 5.

FIG. 5 is a perspective view of floor panel support boss 206. Floor panel support boss 206 is preferably made of plastic with a spoked upper portion 502 and an extended lower portion 504, as shown in FIGS. 5A and 5B. Boss upper portion 502 serves to cushion floor panels 102, whereas boss lower portion 504 serves as a receptacle for panel fastener 600, shown in FIG. 6.

A plastic injection molding process called "over-molding" or "insert-molding" is used to produce a base floor web tile assembly, as shown in FIG. 2. To begin the over-molding/insert-molding process, floor panel supports 204 are loaded into a mold of an automated injection-molding machine which performs the over-molding/insert-molding process. In the base floor web tile assembly shown in FIG. 2, nine metal cylinders 404 of the type show in detail in FIG. 4 are used. Connection pods 304 of base floor web tile 202 are then formed around floor panel support base 408 at the lower portion of metal cylinder 404. Connection pods 304 have over-molded plastic stays 208 that extend over floor panel support base 408 of metal cylinder 404. Stays 208 secure metal cylinders 404 to base floor web tile 202 for installation and use but may still allow for removal and replacement of metal cylinders 404. In addition, notches 410 of cylinder base 408 are filled with plastic forming small "posts" during the over-mold process which prevent the cells from rotating during installation and use. Similarly, floor panel support boss 206 is formed on upper surface 412 of metal cylinder 404 during the over-mold process. Raised lip 402 around the upper circumference of metal cylinder 404 accomodates receipt of floor panel support boss 206.

Figure 6A:
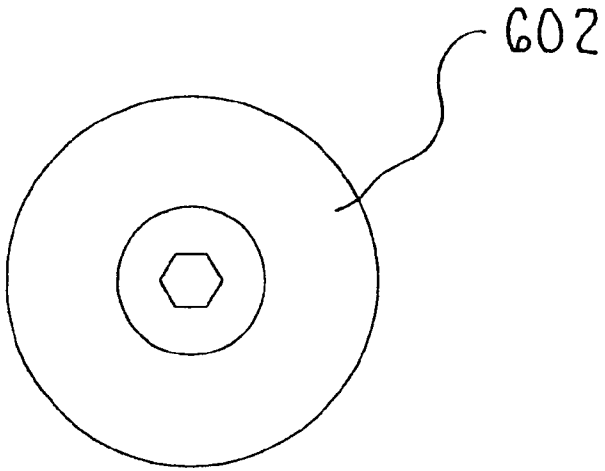
FIG. 6A is a top plan view of the panel fastener of FIG. 6.
Figure 6:
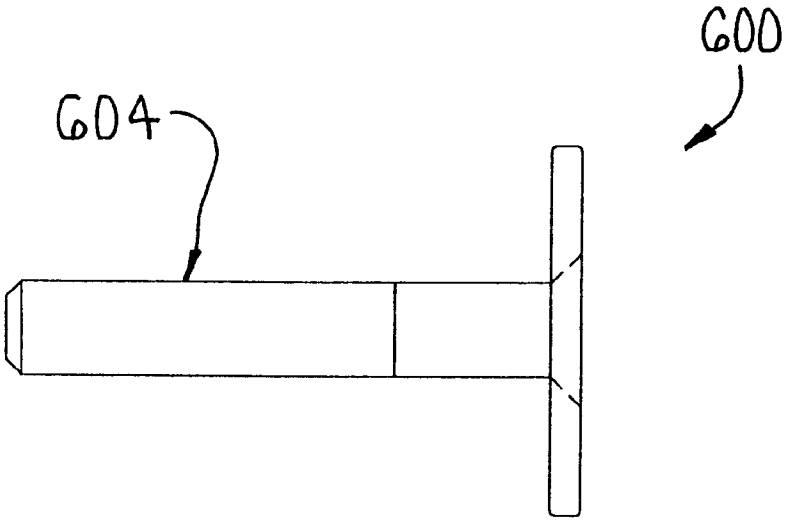
FIG. 6 is a side plan view of a panel fastener.
Figure 7:
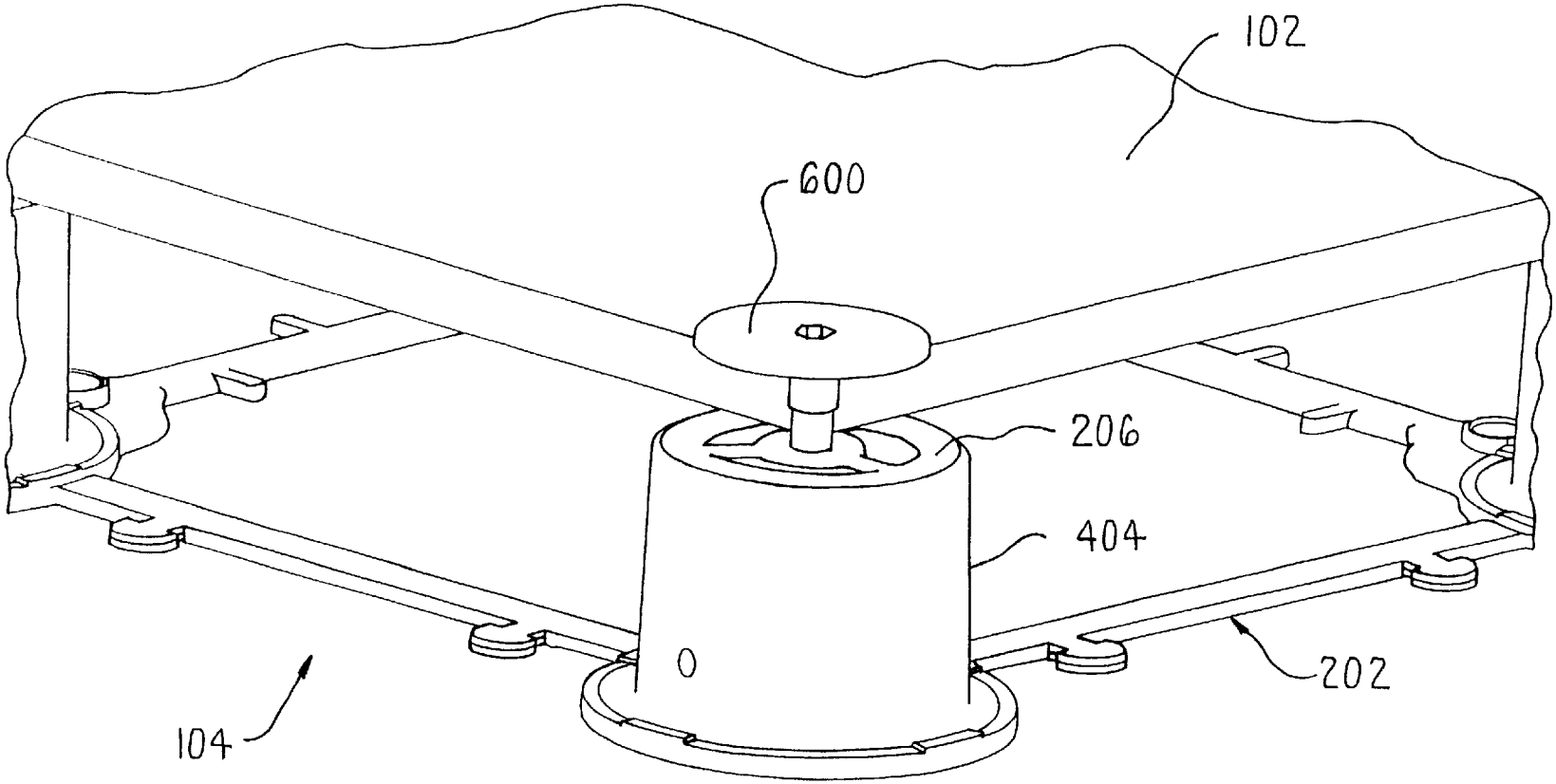
FIG. 7 is a perspective view of a floor panel secured by a panel fastener to the base floor web tile assembly of FIG. 2.
Figure 8:
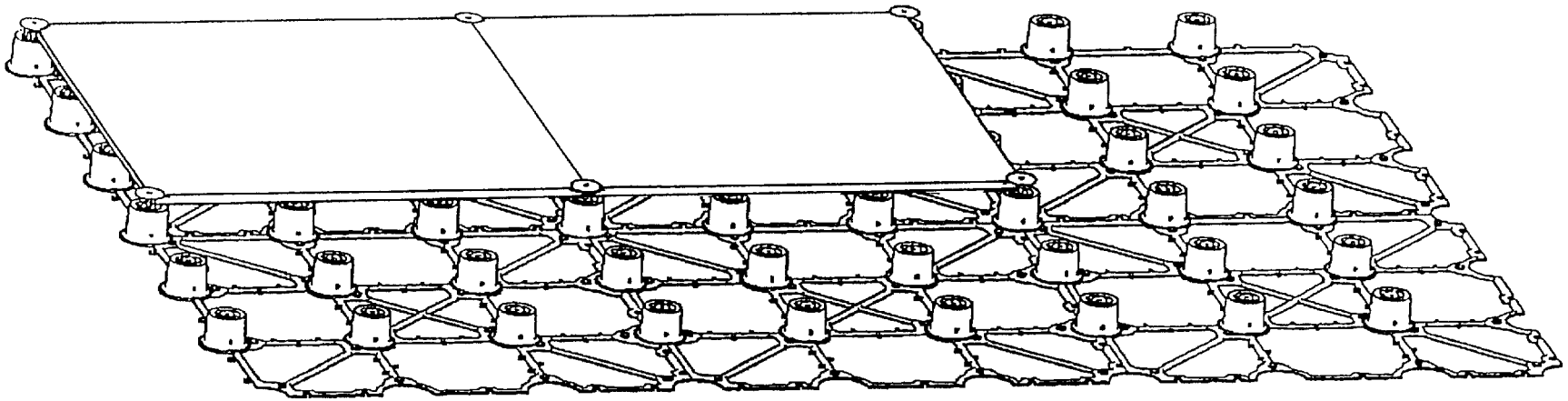
FIG. 8 is a perspective view of two floor panels installed on respective interconnected base floor web tile assemblies.

During installation, floor panel 102 is laid horizontally across the flat upper surface of metal cylinders 404 of corresponding base floor web tile assembly 104, as shown in FIG. 7. In one embodiment, a substantially one-to-one relationship exists between each floor panel and its respective base floor web tile assembly. In another embodiment of the present invention, a plurality of floor panels are configured so as to correspond to one base floor web tile assembly. Each floor panel has a recess 106 in its upper surface at each corner. The corner recess 106 accommodates the width of the flat upper portion 602 of threaded panel fastener 600, as shown in FIG. 6. When panel fastener 600 is screwed into floor panel support boss 206 of metal cylinder 404, it secures the corner of floor panel 102 thereto so that the upper surface of upper portion 602 of threaded panel fastener 600 is flush with the upper surface of floor panel 102, and the lower surface of floor panel 102 is secured against floor panel support boss 206 and upper surface 412 of metal cylinder 404, as shown in FIG. 8. In this way, panel fastener 600 simultaneously secures the corners of four adjacent panels, thereby locating and evenly spacing the panels on the upper surface of the base floor web tile assembly. Further, panel fasteners 600 are constructed with sufficient tolerance to allow for small inconsistencies in the floor level upon installation.

The raised floor system of the present invention is installed on a base floor in a "top-down" process. Once the base floor web tile assemblies are interconnected, to cover the entire base floor or any portion thereof, the assembly need not be lifted to apply adhesive, i.e., the "top" (upper surface of the base floor web tile assembly) remains "down" (installed on the base floor) during application of the adhesive. Thus, a row of base floor web tile assemblies 104 are laid down on the base floor and interconnected by the mating of tabs 314 of one assembly with tab acceptors 316 of an adjoining assembly. In the embodiment of base floor web tile assembly 104 shown in FIG. 9, female snap connectors 1020 of one base floor web tile 902 snap onto the mating male snap connector 1016 of an adjoining base floor web tile 902, as shown in FIG. 12. Mastic is then injected through apertures 310 of adhesion pads 308 of the base floor web tile. The mastic fills the space created under the adhesion pads due to raised radial lines 312 on the underside thereof. The configuration of the adhesion pads, i.e., the placement of apertures and raised radial lines thereunder, eliminates the need to lift the base floor web tile to apply the adhesive.

Raised floor panels 102 are then secured by a threaded panel fastener 600 to the upper surface of floor panel supports 204 of base floor web tile assemblies 104, as previously described. During this step of the installation, the area formed between the raised radial lines of the adhesion pad retain the glue and prevent it from being squeezed out from under the base floor web once the floor panel is secured thereto assuring a firm bond with the base floor.

While the invention has been particularly shown and described with reference to preferred embodiments thereof, it will be understood by those skilled in the art that various changes in form and details may be made therein without departing from the spirit and scope of the invention.

What is claimed is:

1. A raised floor system for installation over a base floor structure, said floor system comprising:

a plurality of interconnected unitary base assemblies, each said unitary base assembly including a lower side for supportive engagement with the base floor structure, a plurality of upright floor panel supports positioned generally along a perimeter of the respective base assembly, and a connector arm radiating outwardly from a base of each said upright support, each said connector arm being releasably interconnected with a said connector arm of an adjacent said base assembly at a position located between adjacent said supports of the respective adjacent base assemblies to interconnect the adjacent base assemblies and horizontally positionally relate same relative to one another; and a plurality of floor panels supported on said upright supports of said base assemblies, said plurality of floor panels together defining a raised floor surface spaced upwardly from the base floor structure.

2. The raised floor system of claim 1 wherein each of said connector arms is cantilevered outwardly from the respective support and has a free end engaged with a free end of a said connector arm of an adjacent base assembly.

3. The raised floor system of claim 1 wherein the interconnected pairs of connector arms define complementary male and female connector parts which cooperatively engage one another.

4. The raised floor system of claim 1 wherein each said base assembly includes a plurality of elongate connector elements and each respective adjacent pair of said upright supports are interconnected by a said connector element, said supports and said connector elements together providing the respective base assembly with an open, grid-like configuration.

5. The raised floor system of claim 1 wherein said floor panels are rectangular in shape and define a recess at each corner thereof, and a panel fastener is disposed within each said recess of said floor panel and engages with an upper end of a said support to releasably secure the respective floor panel to said support.

6. The raised floor system of claim 1 further including a plurality of connection pods integrally connected to one another by a plurality of elongate connector elements arranged in a grid-like manner, each said connection pod being configured to receive said base of one of said upright supports, and at least some of said connector arms have inner ends positioned adjacent the respective base which respectively define adhesive-receiving portions for securing the respective base assemblies to the base floor structure, an outer free end of each said connector arm being respectively interconnected with an outer free end of a said connector arm of a horizontally adjacent base assembly.

7. The raised floor system of claim 6 wherein said adhesive-receiving portions each define an aperture therein which extends between upper and lower oppositely facing surfaces thereof and at least one spacer is disposed on said lower surface such that when said base assembly is positioned upon the base floor structure, a space is defined between said lower surface and the base floor structure which communicates with the respective aperture to permit injection of adhesive thereinto while the base assembly remains substantially in contact with the base floor structure.

8. A unitary base structure for supporting at least one floor panel in vertically spaced relation from a base floor to define a raised floor, said base structure comprising:

a generally rectangular and unitary base member defining a lower surface for supportive engagement with the base floor;

a plurality of generally vertically oriented supports which are cantilevered upwardly from said base member, four of said supports being disposed at respective corners of said base member and upper ends of each of said supports being configured for supportingly engaging at least one floor panel so as to space same upwardly from the respective base member; and an elongate connector element projecting outwardly from each of said corners of said base member beyond the respective supports, whereby each of said connector elements is positively engageable with a said connector element of an additional said base structure disposed in horizontally adjacent relation with said base structure.

9. The base structure of claim 8 wherein each said connector element terminates in a free end spaced horizontally outwardly from the respective support which is configured for releasable engagement with a free end of a connector element of an additional said base member.

10. The base structure of claim 8 further including a plurality of connection pods integrally connected to one another by a plurality of elongate connector strips arranged in a grid-like manner, each said connection pod receiving said base of one of said supports, and a said connector element is connected to and projects horizontally from each said connection pod.

11. The base structure of claim 10 wherein four of said supports are positioned at the respective corners of said base member, and an additional said support is provided between each adjacent pair of corner supports and aligned therewith so as to provide said base member with a rectangular periphery, and a further said support is provided generally centrally within said periphery and is connected to each of said supports located at said periphery by a said connector strip.

12. The base structure of claim 8 wherein said connector elements which project outwardly from the respective corners of said base member are oriented diagonally and are interconnectable to three said connector elements of three horizontally adjacent base structures.

13. The base structure of claim 8 wherein said supports are arranged in rows with one another along said base member and each adjacent pair of said supports are connected to one another by an elongate strip to provide said base member with an open, grid-like configuration.

14. A base arrangement for supporting a plurality of floor panels above a base floor so as to define a raised floor, said base arrangement comprising:

a plurality of unitary base assemblies releasably interconnected with one another in side-by-side horizontally adjacent relation;

each said base assembly including a base member defining a lower surface for supportive engagement with the base floor and including a plurality of upright support members which are fixed to and cantilevered upwardly from said base member for supportingly engaging one or more floor panels to position same in vertically spaced relation from the base floor, said support members being disposed in a generally rectangular formation with one another and defining a periphery of said base member, and a plurality of connectors projecting horizontally from the periphery of at least some of base members, each said connector having an outer free end releasably connected to the outer free end of a said connector of a horizontally adjacent said base assembly.

15. The base arrangement of claim 14 wherein interconnected pairs of said connectors define complementary male and female fasteners which cooperatively engage one another to interconnect adjacent base assemblies to one another.

16. The base arrangement of claim 14 wherein adjacent pairs of said support members are connected to one another by an elongate strip to provide said base assembly with an open, grid-like configuration and a said connector projects horizontally outwardly from a base of each said support member, four of said support members being respectively disposed at four corners of said base assembly, said connectors projecting outwardly from the corner support members being diagonally oriented and said connectors projecting outwardly from respective support members disposed between pairs of corner supports being oriented generally perpendicular with respect to the elongated direction of the adjacent strips.

17. The base arrangement of claim 16 wherein said connectors which project from the corner support members have a horizontal length which is greater than a horizontal length of the other connectors to permit simultaneous connection to three horizontally adjacent base assemblies.

18. The base arrangement of claim 17 wherein only one of said connector elements projecting from a said corner support defines a triple fastener at the free end thereof which is configured for directly connecting to three said connector elements of three horizontally adjacent base assemblies.

19. The base arrangement of claim 16 wherein adhesive receiving portions are defined on at least some of said connector elements and at least some of said strips for adhesively fastening said base assembly to the base floor.

20. A base arrangement for supporting a raised floor in vertically spaced relation from a base floor, said base arrangement comprising a plurality of one-piece and generally rectangular base tiles disposed in side-by-side horizontally adjacent relation with one another, some of said base tiles defining four corners and mounting thereon a plurality of upright supports having upper ends for supportingly engaging one or more generally planar floor panels defining the raised floor, and four elongate connector arms each projecting diagonally outwardly from a said corner of the respective base tile, each said connector arm having an outer free end releasably connected to an outer free end of a said connector arm of a horizontally adjacent base tile, one of said connector arms of each pair of interconnected connector arms defining a male fastening member at said free end thereof and the other said connector arm of the pair defining a female fastening member thereon.

21. The base arrangement of claim 20 wherein additional said connector arms project outwardly from the sides of said base tile between adjacent pairs of corners thereof for connection to a horizontally adjacent base tile, said additional connector arms having a horizontal length which is less than a horizontal length of the respective diagonally oriented connector arms.

22. The base arrangement of claim 20 wherein the free end of each said connector arm is connected to free ends of three said connector arms of three horizontally adjacent base tiles.

23. The base arrangement of claim 22 wherein said fastening member of only one of said connector arms of each said base tile defines one of three male fastening members and three female fastening members arranged in side-by-side relation with one another and respectively engaged with three said fastening members of three horizontally adjacent base tiles.

24. The base arrangement of claim 20 wherein four of said supports are disposed at the respective corners of each said base tile, and an additional said support is disposed between and aligned with each adjacent pair of corner supports along a periphery of said base tile, and a center support is disposed within the periphery of each base tile, each adjacent pair of said supports being connected to one another by an elongate strip so as to provide each said base tile with an open, grid-like configuration, said connector arms projecting horizontally and diagonally outwardly from respective base portions of the four corner supports.

* * * * *